US006086330A

United States Patent [19]

Press et al.

[11] Patent Number: 6,086,330

[45] Date of Patent: Jul. 11, 2000

[54] LOW-NOISE, HIGH-PERFORMANCE FAN

[75] Inventors: Minoo D. Press; Debabrata Pal, both of Schaumburg; Martinho R. Pais, North Barrington, all of Ill.

[73] Assignee: Motorola, Inc., Schaumburg, Ill.

[21] Appl. No.: 09/217,157

[22] Filed: Dec. 21, 1998

[51] Int. Cl.[7] ..... B63H 1/26

[52] U.S. Cl. ..... 416/223 R; 416/243; 416/DIG. 2; 416/DIG. 5; 415/119

[58] Field of Search ..... 416/223 R, 243, 416/DIG. 2, DIG. 5; 415/119

[56] References Cited

U.S. PATENT DOCUMENTS

| | | | |
|---|---|---|---|
| 4,358,245 | 11/1982 | Gray . | |
| 4,475,867 | 10/1984 | Smith . | |
| 4,807,718 | 2/1989 | Lotz . | |
| 5,249,928 | 10/1993 | Schulz | 416/223 R |
| 5,320,493 | 6/1994 | Shih et al. . | |
| 5,326,225 | 7/1994 | Gallivan et al. . | |
| 5,342,167 | 8/1994 | Rosseau . | |
| 5,388,956 | 2/1995 | Pla et al. . | |
| 5,393,199 | 2/1995 | Alizadeh . | |
| 5,564,901 | 10/1996 | Moore . | |
| 5,577,888 | 11/1996 | Capdevilla et al. . | |
| 5,681,145 | 10/1997 | Neely et al. | 416/203 |

*Primary Examiner*—Edward K. Look
*Assistant Examiner*—Ninh Nguyen
*Attorney, Agent, or Firm*—Douglas D. Fekete

[57] ABSTRACT

The present invention provides a fan (100) that includes a hub (102) and a plurality of blades (104). The hub (102) has a blade attachment surface (106) that extends around the circumference of the hub (102). The blades (104) extend from the blade attachment surface (106). Each of the blades (104) has a blade tip (108) distal from the blade attachment surface (106) and a chord length (110) defined as the width of the blade (104). Each blade (104) includes a hub chord length (112) defined as the chord length of the blade (104) at the blade attachment surface (106) and a tip chord length defined as the chord length at the blade tip (108). The relationship of the chord length to the blade radius is defined as the area bounded by the following equations:

blade radius=0.0205 meters blade radius=0.0369 meters chord length=0.438*(blade radius)+0.021 m chord length=0.438*(blade radius)+0.028 m, and the blade angle is defined as the area bounded by the following equations:

blade radius=0.0205 meters blade radius=0.0369 meters blade angle=−625*(blade radius)+53 m blade angle=−469*(blade radius)+57 m.

20 Claims, 4 Drawing Sheets

100

500

700

LOW-NOISE, HIGH-PERFORMANCE FAN

FIELD OF THE INVENTION

The present invention relates generally to axial flow fans.

BACKGROUND OF THE INVENTION

Electronic devices that include electronic components often generate heat during normal operation. Although some amount of heat build up is acceptable, the electronic devices perform optimally when excess heat is removed from the device.

One method used to remove heat from electronic devices is to have a fan blow air over the surface of the heat-generating components to remove heat to the ambient environment. A further way of removing heat is to use a heat sink or the like to remove heat from the electronic device. Although heat sinks are able to remove heat by themselves, heat sinks remove a significantly greater amount of heat when coupled with a fan to increase air flow through the fins of the heat sink.

One problem associated with fans is the amount of air flow generated by the fan. The greater the heat load, the greater the amount of air flow is required to remove heat from the device. This is true whether or not a heat sink is associated with the fan. However, the heat sink becomes more compact as the heat load increases. Consequently the pressure drop increases, thereby reducing the air moving capacity of the fan.

A second problem associated with fans is the noise that they generate. Various methods have been attempted to minimize the amount of excess noise that fans add to a device. Such methods include elective choice of impeller geometry, utilizing a variable-speed fan, applying sound absorbing material around the fan and the duct housing, and locating the fan remotely from the device. These techniques have been inadequate in reducing noise for high airflow applications.

Consequently, a need exists for a low-noise, high-performance fan that is effective in producing an adequate air flow in electronic devices while not adding significant noise to the device.

DETAILED DESCRIPTION OF A PREFERRED EMBODIMENT

The present invention comprises a fan that provides for increased air flow and lower noise than fans currently available. The fan includes a plurality of blades that are designed in a manner that increases air flow over prior art fans but decreases the noise produced by the fan.

Figure 1:
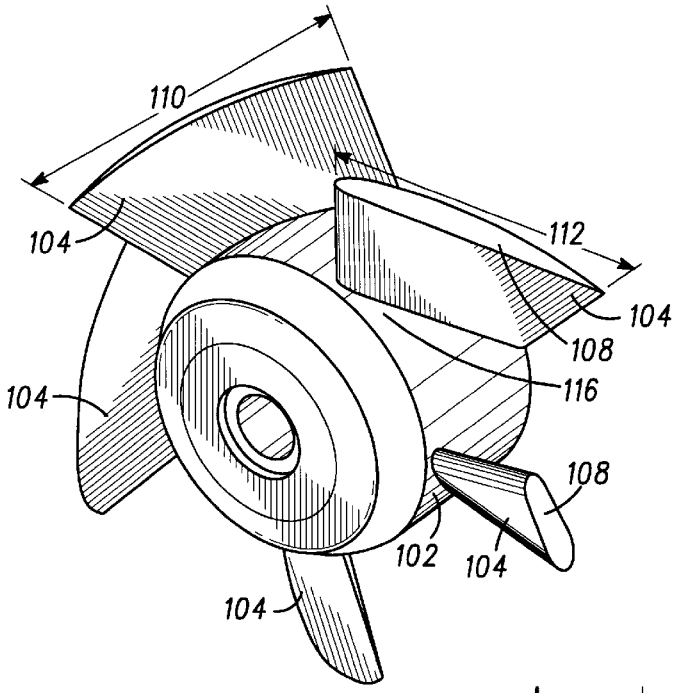
FIG. 1 depicts a three-dimensional plan view of a fan in accordance with the preferred embodiment of the present invention.

The present invention can be better understood with reference to FIGS. 1–7. FIG. 1 depicts a three-dimensional plan view of a fan 100 in accordance with the preferred embodiment of the present invention. Fan 100 is preferably formed of a plastic, but can alternately be formed of a metal, such as aluminum or magnesium, or a metallic alloy, such as steel. In the preferred embodiment, fan 100 is formed of a thermoplastic commercially available under the tradename "RADEL" sold by General Electric, Co. RADEL is an energy-absorbing, glass-filled polycarbonate. Fan 100 can be formed via injection molding, die casting, or other suitable methods.

Fan 100 includes a hub 102 and a plurality of blades 104. Fan 100 preferably includes between 4 and 7 blades. Each of the blades 104 is designed in such a manner as to maximize air flow while reducing the noise produced during use of fan 100. In the preferred embodiment, each blade 104 is generally airfoil-shaped. The shape of blades 104 is critical to the generation of lift, and the noise is partially determined by the drag of each blade 104. Hence, the lift coefficient CL and the drag coefficient $C_D$ preferably lie within the range specified by:

$$C_L=f(\alpha)=0.53988+0.08894\alpha-0.00119\alpha^2$$

$$C_D/C_L=f(\alpha)=0.0119-0.0043\alpha+0.00096\alpha^2$$

Wherein $\alpha$ is the angle between chord length 110 and the direction of gas flow relative to blade 104 at the leading edge thereof.

Each blade is preferably smoothed to provide a low-friction surface. A preferred blade has a surface finish that is smoother than about 600 grit. Each of the blades 104 is attached to hub 102 at blade attachment surface 106. Blade attachment surface 106 extends about the circumference of hub 102.

Each blade 104 includes a chord length 110. Chord length 110 is defined as the distance from the leading edge to the trailing edge of each blade 104. Each blade 104 has a blade thickness, and in the preferred embodiment, the blade thickness is between about 0.4 mm and 0.7 mm. In the preferred embodiment, the ratio of the blade thickness to the chord length is between about 0.08 and 0.2.

Each blade 104 includes a hub chord length 112 defined as the chord length of blade 104 at hub 102, and a tip chord length 114, defined as the chord length of blade 104 at tip 108. Each blade 104 has a tip chord length 114 that is greater than or equal to hub chord length 112.

Each blade tip 108 is spaced apart from a housing piece (not shown) by a tip clearance. In the preferred embodiment, the tip clearance is between about 0.1 and 0.8 mm.

Each blade 104 is attached and aligned to hub 102 at an angle 116. As described below with respect to FIG. 3, the angle 116 decreases throughout the length of blade 104, such that the angle of blade 104 at tip 108 is less than the angle of blade 104 at blade attachment surface 106. In the preferred embodiment, the trailing edges of blades 104 are aligned to be co-planar and normal to the axis of rotation of hub 102. Each blade 104 is preferably oriented in a normal direction at hub 102 and is oriented in a swept forward position from hub 102 to the tip 108. Alternately, each blade 104 is oriented in a normal direction at hub 102 and is oriented in a swept backward position from hub 102 to tip 108. Each chord has a midpoint that is preferably generally tangential to blade attachment surface 106.

Blades 104 can be attached to hub 102 at blade attachment surface 106 by various methods. In the preferred embodiment, blades 104 are formed via an injection molding process. In an alternate embodiment of the present invention, blades 104 are ultrasonically bonded to hub 102. Each blade 104 is positioned on hub 102 such that the blade fits into a groove formed at blade attachment surface 106 of hub 102. An ultrasonic horn creates a bond between the blade and the hub at various locations, thereby bonding each blade 104 to hub 102.

In a further alternate embodiment of the present invention, blades 104 are sweat fitted to hub 102 at blade attachment surface 106. Each blade 104 is heated to a high temperature, such as to between about 145 and 160° C. A low-temperature solder, such as an alloy formed of approximately 50 weight percent tin, 25 weight percent lead, and 25 weight percent cadmium, can be used. Each blade is then placed so that a feature protruding from blade attachment surface 106 on hub 102 fits inside a slot on blade 104. Blade 104 is then cooled, which shrinks the matching slot, providing a tight fit on the protruding feature of hub 102.

In a further alternate embodiment of the present invention, each blade 104 is attached to hub 102 using a swaged attachment process. Each blade 104 is placed inside a matching groove formed on hub 102. Swaging rollers are inserted between each blade 104 and hub 102 within the groove and pressure is applied. The swaging rollers cold form each blade 104 to hub 102.

Figure 2:
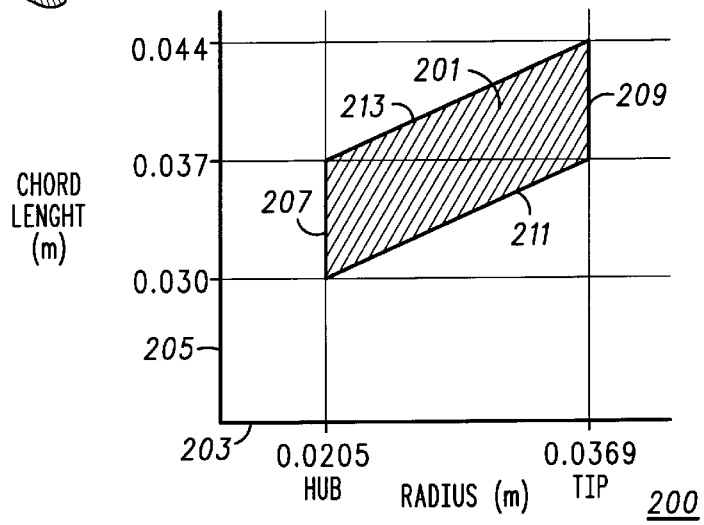
FIG. 2 depicts a graph of chord length ranges for blades on the fan in accordance with the preferred embodiment of the present invention.
Figure 4:
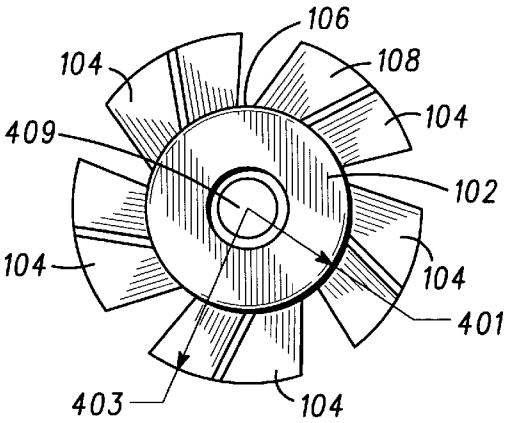
FIG. 4 depicts a top view of a fan in accordance with the preferred embodiment of the present invention.

FIG. 2 depicts a graph 200 of the range of chord lengths for blades on the fan in accordance with the preferred embodiment of the present invention. Fans within the preferred embodiment of the present invention have chord lengths within the cross-hatched area 201 of graph 200. X-axis 203 defines the radius in meters as a distance from the center of hub 102. The hub radius, as depicted in FIG. 4, is defined as the distance from the center of hub 102 to blade attachment surface 106. The tip radius, as depicted in FIG. 4, is defined as the distance from the center of hub 102 to tip 108 of blade 104. Y-axis 205 represents the chord length 110 of blade 104.

Area 201 is bounded by the lines defined by the following equations:

line 207 is defined by the equation:

$$x=0.0205 \text{ meters}$$

line 209 is defined by the equation:

$$x=0.0369 \text{ meters}$$

line 211 is defined by the equation:

$$y=0.438x+0.021 \text{ meters}$$

line 213 is defined by the equation:

$$y=0.438x+0.028 \text{ meters}$$

Line 207 defines the lower limit of the hub radius. The hub radius must be at least 0.0205 meters in order to fit on the preferred motor. Line 209 defines the maximum radius of the tip radius, which is 0.0369 meters. This maximum will also allow the blades to fit within conventional housing assemblies.

Area 201 is defined as the area bounded by the above four equations. As the radius from the center of hub 102 increases, chord length 110 of each blade 104 also increases. Blades having a relationship of chord length to radius within area 201 have been found to produce greater air flow while producing less noise than conventional fans. The variation in chord length can take the form of a linear or nonOlinear relationship within area 201.

Figure 3:
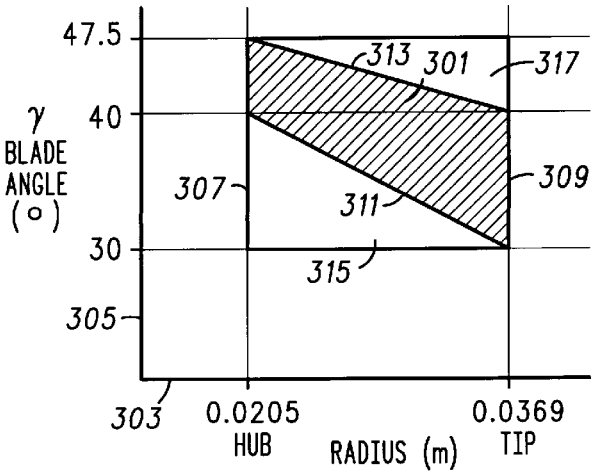
FIG. 3 depicts a graph of blade angle ranges for blades of a fan in accordance with the preferred embodiment of the present invention.

FIG. 3 depicts a graph 300 of the range of blade angles for blades 104 of fan 100 in accordance with the preferred embodiment of the present invention. Fans within the preferred embodiment of the present invention have blade angles within the cross-hatched area 301 of graph 300. X-axis 303 defines the radius in meters as a distance from the center of hub 102. The hub radius is defined as the distance from the center of hub 102 to blade attachment surface 106. The tip radius is defined as the distance from the center of hub 102 to tip 108 of blade 104. Y-axis 305 represents the blade angle 116, in degrees, of blade 104. Blade angle 116 is oriented with respect to the plane of rotation of hub 102.

Area 301 is bounded by the area defined by the following equations:

line 307 is defined by the equation:

$$x=0.0205$$

line 309 is defined by the equation:

$$x=0.0369$$

line 311 is defined by the equation:

$$y=-625x+53$$

line 313 is defined by the equation:

$$y=-469x+57$$

As stated with regard to FIG. 2, the hub radius of a fan in accordance with the present invention is at least 0.0205 meters, while the blade radius is less than about 0.0369 meters.

Area 301 is defined as the area bounded by the above four equations. As the radius from the center of hub 102 increases, blade angle 116 of each blade 104 decreases. Blades having a relationship of blade angle to radius within area 301 have been found to produce greater air flow while producing less noise than conventional fans. As depicted in FIG. 3, as the length if the blade increases, the angle of the blade with respect to the plane of rotation decreases, thereby provided enhanced air flow with minimized noise. The variation in angle can take the form of a linear or non-linear relationship within area 301.

Shaded area 315 is defined as the area below line 311. Applicants have found that fans designed with blade angles within shaded area 315 have a manufacturing problem when manufactured using conventional techniques. The blades were overlapping during an injection molding process, particularly when the blades were overlapping. Shaded area 317 is defined as the area above line 313. Applicants have found that fans designed with blade angles within shaded area 317 have unstable operation during use. Fans manufactured with blade angles in relation to radius as depicted within cross-hatched area 301 have been found to provide excellent air flow, lower noise, no manufacturing problems, and stable operation, thereby alleviating problems associated with prior art fans.

FIG. 4 depicts a top view of fan 100 in accordance with the preferred embodiment of the present invention. Fan 100 includes a plurality of blades 104 attached to hub 102 at blade attachment surface 106. Each blade 104 has a tip 108 distal from blade attachment surface 106. Hub radius 401 is defined as the distance from hub center 409 to blade attachment surface 106. Tip radius 403 is defined as the distance from hub center 409 to tip 108.

The ratio of hub radius 401 to tip radius 403 preferably falls within the range between about 0.55 and 0.75. In other words, hub radius 401 is preferably between about 55% and 75% of tip radius 403.

Figure 5:
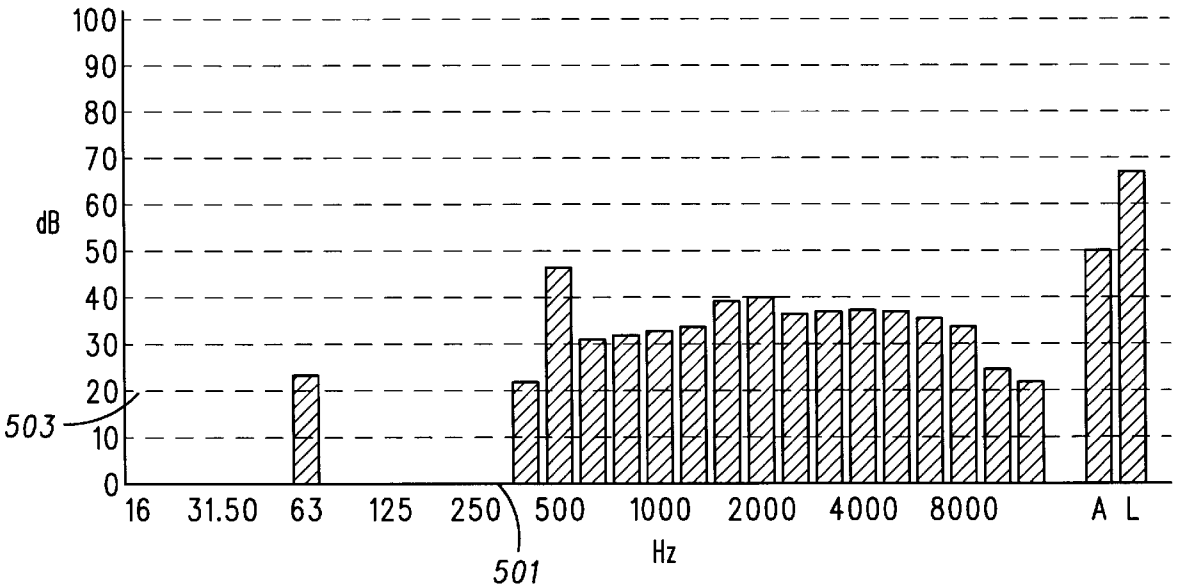
FIG. 5 depicts a bar diagram of the sound pressure level spectrum associated with a fan manufactured in accordance with the preferred embodiment of the present invention.
Figure 6:
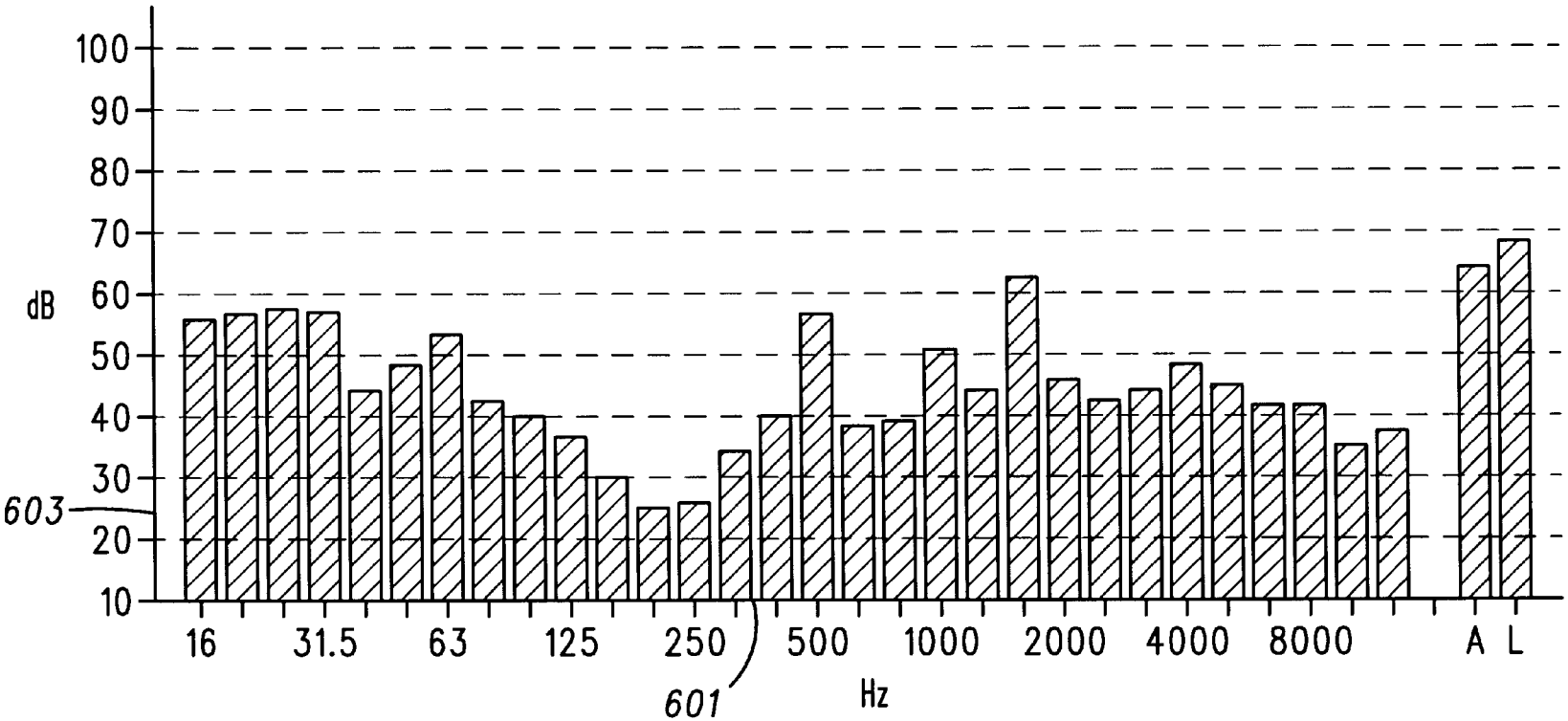
FIG. 6 depicts a bar diagram of the sound pressure level spectrum associated with a fan manufactured in accordance with the prior art.

FIGS. 5 and 6 depict sound pressure level spectra of fans. FIG. 5 depicts the sound level spectrum of a fan manufactured in accordance with a preferred embodiment of the present invention. FIG. 6 depicts a sound level spectrum of a prior art fan. The test conditions for testing the fans were substantially identical. Both performance curves, i.e. pressure-flow rate, are taken at an identical fan speed. Noise from both fans was measured at free flow at the same speed inside an anechoic chamber at a distance of 1 m. The temperature was approximately 25° C. during all experiments.

FIG. 5 depicts a bar diagram 500 of the sound pressure level spectrum associated with a fan manufactured in accordance with the preferred embodiment of the present invention.

X-axis 501 depicts frequency, in Hertz (Hz), of the fan during testing. Y-axis 503 depicts, in decibels (dB), sound pressure level generated by a fan in accordance with the preferred embodiment of the present invention.

The $L_{EQ}$ is the sound pressure level. It is an A-weighted, equivalent noise level having an interval of 30 seconds. It is a measure of the loudness and is determined by the measurement of the average acoustic pressure over the audible spectrum. The $L_{EQ}$ for a fan manufactured in accordance with the preferred embodiment of the present invention is approximately 48.8 dB.

FIG. 6 depicts a bar diagram 600 of the sound pressure level spectrum associated with a fan manufactured in accordance with the prior art. More particularly, the fan tested was an MIL-80 fan sold by "AMETEK-ROTRON". This fan has the highest flow for 80 mm axial flow fans. The test parameters for a prior art fan were the same as the test parameters for a fan in accordance with the present invention as depicted in FIG. 5.

As can be seen from bar diagram 600, a prior art fan emits significantly more noise than a fan manufactured in accordance with the preferred embodiment of the present invention. The LEQ for a prior art fan is approximately 63.1 dB. A noise reduction of approximately 14 to 15 dBA has been achieved utilizing the present invention as compared with the highest grade commercial fans using identical flow and pressure rise.

Figure 7:
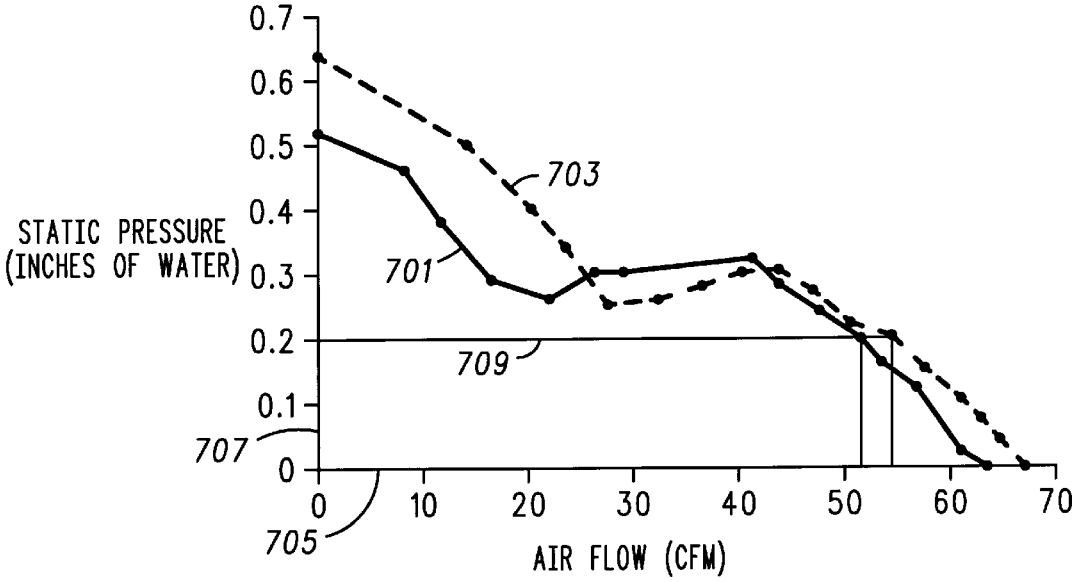
FIG. 7 depicts a graph of static pressure and air flow for a fan manufactured in accordance with the preferred embodiment of the present invention and a fan manufactured in accordance with the prior art.

FIG. 7 depicts a graph 700 of static pressure and air flow for a fan manufactured in accordance with the preferred embodiment of the present invention and a fan manufactured in accordance with the prior art. X-axis 705 depicts the air flow for a fan in cubic feet per minute (CFM). Y-axis 707 depicts the static pressure, measured in inches of water.

Line 701 depicts a graph of the air flow for a prior art fan graphed against the static pressure. Line 703 depicts a graph of the air flow for a fan manufactured in accordance with the preferred embodiment of the present invention. Line 709 depicts the static pressure drop for a compact heat sink in an electronic assembly.

As can be seen, a fan manufactured in accordance with the preferred embodiment of the present invention develops greater overall pressure across the range of air flows than a prior art fan. At a general operating pressure, about 0.2 inches of water, a prior art fan has an air flow of about 52 CFM. A fan manufactured in accordance with the preferred embodiment of the present invention has an air flow of about 55 CFM at 0.2 inches of water. This is approximately a 5.8% increase in air flow at the general operating pressure.

The present invention comprises a fan that emits low noise while providing high performance. A fan manufactured in accordance with the present invention has a unique design that has been found to have substantial low-noise emission while at the same time develops equal or higher static pressure than prior art fans. This reduction in noise leads to increased static pressure at a given air flow while at the same time reducing the sound emitted by the fan. This increase in air flow with minimized noise leads to a fan that is effective to be used in a variety of applications, such as computers, network servers, RF equipment, overhead projectors, car cabin ventilation, or wherever fan noise can be deleterious.

While this invention has been described in terms of certain examples thereof, it is not intended that it be limited to the above description, but rather only to the extent set forth in the claims that follow.

We claim:

1. A fan comprising:

a hub having a blade attachment surface extending around the circumference of the hub and a hub radius;

a plurality of blades extending from the blade attachment surface, each of the plurality of blades having a blade tip distal from the blade attachment surface, a chord length defined as the width of the blade, a hub chord length defined as the chord length of the blade at the blade attachment surface, and a tip chord length defined as the chord length at the tip of the blade, wherein the relationship of the chord length to the (blade radius) is defined as the area bounded by the following equations:

(blade radius)=0.0205 meters blade radius=0.0369 meters chord length=0.438*(blade radius)+0.021 meters chord length=0.438*(blade radius)+0.028 meters, and wherein the blade angle is defined as the area bounded by the following equations:

blade radius=0.0205 meters blade radius=0.0369 meters blade angle=−625*(blade radius)+53° blade angle=−469*(blade radius)+57°.

2. A fan in accordance with claim 1, wherein the blade is generally airfoil-shaped.

3. A fan in accordance with claim 1, wherein the ratio of the hub radius to the tip radius is between about 0.55 and 0.75.

4. A fan in accordance with claim 1, wherein the blade has a surface finish smoother than about 600 grit.

5. A fan in accordance with claim 1, wherein the blade has a blade thickness, and wherein the thickness of the trailing edge is between about 0.4 mm and 0.7 mm.

6. A fan in accordance with claim 5, wherein the ratio of the blade thickness to the chord length is between about 0.08 and 0.2.

7. A fan in accordance with claim 1, wherein the tip clearance is between about 0.1 and 0.8 mm.

8. A fan in accordance with claim 1, wherein the trailing edges of the blades are aligned to be co-planar and normal to the axis of rotation.

9. A fan in accordance with claim 1, wherein the hub radius is greater than about 0.0205 meters.

10. A fan in accordance with claim 1, wherein the tip radius is less than about 0.0369 meters.

11. A fan in accordance with claim 1, wherein the hub and the plurality of blades are formed of a plastic.

12. A fan in accordance with claim 1, wherein the hub and the plurality of blades are formed of a metal.

13. A fan in accordance with claim 1, wherein the hub and the plurality of blades are formed of a metallic alloy.

14. A fan in accordance with claim 1, wherein each blade has a leading edge, a chord length and a lift coefficient $C_L$ associated therewith, and wherein the lift coefficient $C_L$ is defined by the equation:

$$C_L=f(\alpha)=0.53988+0.08894\alpha-0.00119\alpha^2$$

wherein $\alpha$ denotes the angle between the chord length and gas flow relative to the leading edge.

15. A fan in accordance with claim 14, wherein each blade has a drag coefficient $C_D$ associated therewith, and wherein the ratio of the drag coefficient $C_D$ to the lift coefficient $C_L$ is defined by the equation:

$$C_D/C_L=f(\alpha)=0.0119-0.0043\alpha+0.00096\alpha^2.$$

16. A fan in accordance with claim 1, wherein the blade is oriented in a normal direction with relationship to the hub.

17. A fan in accordance with claim 1, wherein the blade is oriented in a normal direction at the hub, and wherein the blade can is oriented in a swept forward position from the hub to the tip.

18. A fan in accordance with claim 1, wherein the blade is oriented in a normal direction at the hub, and wherein the blade can is oriented in a swept backward position from the hub to the tip.

19. A fan in accordance with claim 1, wherein the chord has a midpoint, and wherein the midpoint is generally tangential to the hub surface.

20. A fan in accordance with claim 1, wherein the fan comprises between 4 and 7 blades.

* * * * *